US007735622B2

(12) United States Patent
String

(10) Patent No.: US 7,735,622 B2
(45) Date of Patent: Jun. 15, 2010

(54) COIN MACHINE WITH SELF-CLEANING INTAKE HOPPER AND RELATED METHOD

(76) Inventor: Gregory F. String, 411 Huron Dr., Mechanicsburg, PA (US) 17050

( * ) Notice: Subject to any disclaimer, the term of this patent is extended or adjusted under 35 U.S.C. 154(b) by 0 days.

(21) Appl. No.: 11/834,805

(22) Filed: Aug. 7, 2007

(65) Prior Publication Data

US 2008/0039004 A1 Feb. 14, 2008

Related U.S. Application Data

(60) Provisional application No. 60/821,758, filed on Aug. 8, 2006.

(51) Int. Cl.
*G07F 1/04* (2006.01)

(52) U.S. Cl. ..... 194/347; 453/6; 453/10; 453/12; 453/49; 453/57

(58) Field of Classification Search ..... 194/347, 194/353; 453/6, 10, 12, 33–35, 49, 57, 63
See application file for complete search history.

(56) References Cited

U.S. PATENT DOCUMENTS 5,114,381 A * 5/1992 Ueda et al. ..... 453/57
5,285,883 A 2/1994 Le Hong et al.
5,295,899 A 3/1994 Adams et al.
5,551,911 A 9/1996 Adams et al.
5,971,162 A * 10/1999 Allagnat et al. ..... 209/705
6,168,001 B1 1/2001 Davis
7,004,831 B2 * 2/2006 Hino et al. ..... 453/5
7,059,957 B2 6/2006 Kurosawa et al.
2006/0054457 A1 * 3/2006 Long et al. ..... 194/347

* cited by examiner

*Primary Examiner*—Jeffrey A Shapiro
(74) *Attorney, Agent, or Firm*—Hooker & Habib, P.C.

(57) ABSTRACT

A hopper for a coin processing machine has a turntable that receives coins and rotates in a first direction to discharge coins from the hopper. A circumferential wall surrounds the turntable, and includes a coin discharge opening and a second opening. A diverter plate extends away from the wall upstream of the second opening. The diverter plate blocks coins from entering the second opening when the turntable rotates in the first direction. The diverter plate directs any debris remaining on the turntable to the second opening when the turntable rotates in the opposite, second direction after discharging all the coins from the hopper.

11 Claims, 1 Drawing Sheet

COIN MACHINE WITH SELF-CLEANING INTAKE HOPPER AND RELATED METHOD

Figure 1:
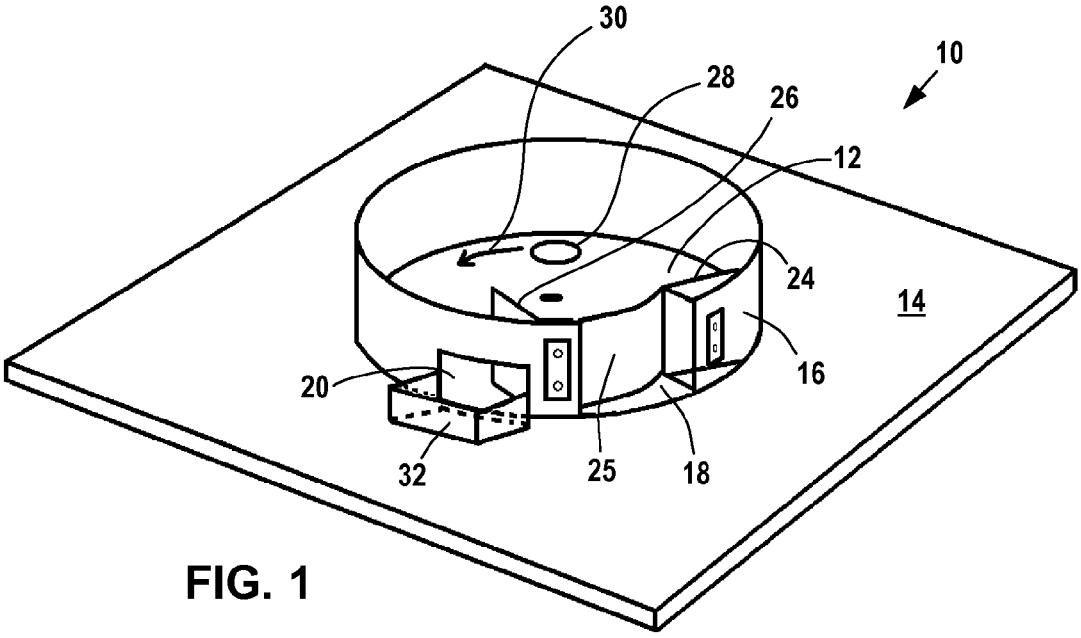

This application claims priority to my provisional patent application No. 60/821,758 filed Aug. 8, 2006 and titled "Coin Machine with Self-Cleaning Intake Hopper", which provisional application is incorporated by reference as if fully set forth herein.

FIELD OF THE INVENTION

The invention relates to coin processing machines for sorting, counting, or verifying coins or like tokens, and particularly to coin processing machines that include an intake hopper having a rotating turntable that receives and discharges the coins.

BACKGROUND OF THE INVENTION

Coin machines such as coin sorters and coin verifiers have an intake hopper that receives coins to be sorted or verified. The coins fall on a rotating turntable surrounded by a stationary outer circumferential wall. Centrifugal force urges the coins against the wall. An opening in the wall causes a stream of coins to be discharged from the hopper for processing. My published US patent application US20060154589 (which is incorporated by reference as if fully set forth herein) discloses such a coin machine having an intake hopper with a rotating turntable.

The coins fed into the hopper are often contaminated by debris such as bent or oversized coins, nuts and bolts, and the like. The debris cannot exit through the wall opening and so remains on the turntable. The debris must be removed by hand after all the coins are processed, a labor-intensive operation.

Thus there is a need to automatically remove debris from the turntable of a coin processing machine.

SUMMARY OF THE INVENTION

The invention is a second opening in the circumferential wall surrounding the turntable of the intake hopper of a coin processing machine. The opening is sized to enable bent coins and other debris through the opening. A diverter plate extends away from the wall upstream of the second opening. The diverter plate blocks access to the second opening when the turntable rotates in its normal operating or coin discharge direction to discharge coins.

After the coins are discharged from the hopper, only debris remains on the turntable. The turntable then rotates in the opposite, or cleaning, direction. The diverter plate directs and urges the debris through the secondary opening for discharge from the hopper. The debris preferably falls through a slot for disposal.

In preferred embodiments of the invention the turntable automatically reverses from the discharge direction to the cleaning direction after no more coins are being discharged from the hopper. In one embodiment of a self-serve, self-standing coin machine, the turntable reverses direction and rotates in the cleaning direction for five seconds after a customer presses a PRINT key to obtain a receipt for the value of the coins fed into the machine.

The invention enables a turntable to be easily and automatically cleaned of debris without the need for manual cleaning by merely reversing the turntable's rotation under automatic machine control after the coins have been discharged from the hopper.

Other objects and features of the invention will become apparent as the description proceeds, especially when taken in conjunction with the accompanying drawing sheet illustrating an embodiment of the invention.

BRIEF DESCRIPTIONS OF THE DRAWINGS

Figure 2:
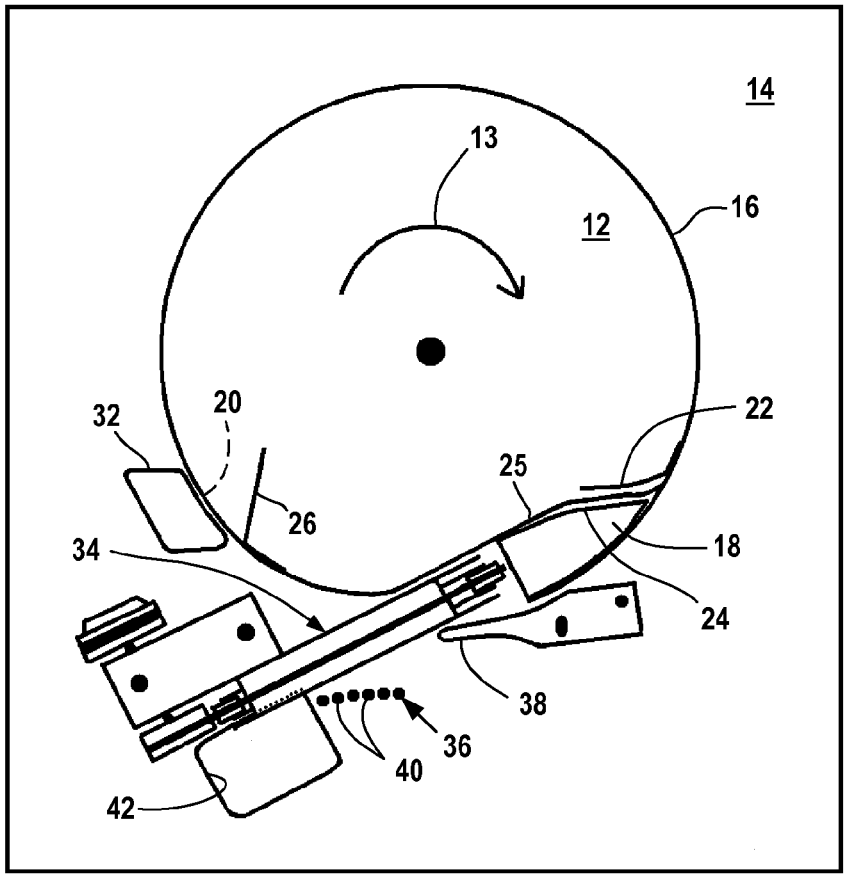

FIG. 1 is a top perspective view of a portion of the intake hopper disclosed in my '598 published patent application and modified in accordance with the present invention; and FIG. 2 is a top view of the intake hopper shown in FIG. 1 adapted for use in a coin processing machine that counts but does not sort coins.

DESCRIPTION OF THE PREFERRED EMBODIMENT

FIGS. 1 and 2 illustrate a portion of an intake hopper 10 in accordance with the present invention.

Intake hopper 10 includes a rotating turntable 12 that receives coins to be discharged from the hopper. Turntable 12 normally rotates in the direction of arrow 13 (clockwise as shown in FIG. 2) to discharge coins from the hopper. The turntable 12 is mounted essentially flush with a stationary mounting plate 14. Attached to plate 14 and extending around the circumference of turntable 12 is a stationary outer wall 16. Wall 16 has a first circumferential opening 18 for discharging coins from the hopper and a second circumferential opening 20 spaced from opening 18 for discharging debris from the hopper as will be described in greater detail below.

Upstream from opening 18 with respect to the normal operating direction represented by arrow 13 is a singulating plate or finger 22. Singulating plate 22 extends radially inwardly from the wall and extends downstream towards opening 18. Plate 22 is spaced above the turntable by a distance less than twice the thickness of the thinnest coin to be processed (a dime when processing US currency).

Extending downstream from plate 22 is a barrier plate 24 that forms a wall or barrier 25 located inwardly from opening 18. Plate 24 extends to the downstream end of opening 18 with barrier 25 closely spaced above the turntable to prevent coins or other objects from passing beneath it and being discharged from the hopper through opening 18. Barrier plate 24 can be formed as an integral part of wall 16, or can be fabricated as a separate component from the remainder of wall 16.

Adjacent the upstream end of second opening 20 is diverter plate 26. Diverter plate 26 extends radially inwardly from wall 16 and extends downstream at least partially across from opening 20.

During normal operation of hopper 10, coins are fed onto turntable 12 rotating in the direction of arrow 13. Coins are forced by centrifugal force against wall 16 and travel along the wall towards singulating plate 22. Singulating plate 22 allows a single-thickness stream of coins that are against wall 16 to pass under the plate 22 and be discharged from hopper opening 18.

Stacked coins, coins that are not against wall 16, and debris (such as bent or oversized coins, nuts and bolts, etc.) that cannot pass under plate 22 are diverted by plate 22 radially inwardly on the turntable and move downstream on the turntable along barrier plate 24, and beyond the downstream end of opening 18 along wall 16 to diverter plate 26. Diverter plate 26 forces the remaining coins and debris on the turntable radially inwardly and away from second opening 20 so that the coins remain on the turntable until they again arrive at singulating plate 22.

After all the coins are discharged from turntable 12 through first wall opening 18, only debris remains on the turntable. FIG. 1 illustrates debris 28 (an oversized coin) remaining on the turntable after all the coins have been discharged from the hopper.

Turntable 12 now rotates in an opposite cleaning direction represented by arrow 30 to discharge debris from the hopper 10. Debris 28 is driven by centrifugal force against wall 16 but now moves in the direction of arrow 30. Debris engaged against wall 16 is discharged from the hopper through wall opening 20 and, in the illustrated embodiment, is held within open-ended container 32 mounted on plate 14. In yet other embodiments a through-opening can be provided in plate 14 to receive debris discharged from opening 20.

Some debris that is not against wall 16 will be carried on the turntable past opening 20 and will engage the side of diverter plate 26 facing opening 20. The diverter plate 26 will direct this debris to opening 20 where it will be discharged from the hopper.

Yet other debris may be carried on the turntable past diverter plate 26. Barrier wall 24 will prevent the debris from being discharged through wall opening 18. The debris will continue on the platter moving in a cleaning direction turntable until they again arrive at wall opening 20 and diverter plate 26 for another opportunity to be discharged from the hopper.

In possible embodiments turntable 12 can automatically change direction of rotation from its normal operating direction to the cleaning direction when it is sensed that coins are no longer being discharged from the hopper through opening 18.

FIG. 2 illustrates a belt drive 34 as described in my '589 published patent application and mounted on plate 14. Belt drive receives a stream of coins discharged from hopper 10 and drives each coin across a sensor device 36. Sensor device 36 forms part of a controller (not otherwise shown) that controls operation of the coin processing machine. Sensor device 36 includes a guide finger 38 that orients the coins in a predetermined location with respect to sensors 40.

Operation of the sensor device 36 is described in my '589 application. The sensor device 36 recognizes the diameter, and hence denomination, of each coin discharged from the hopper. Sensor device 36 transmits a signal to an accumulator (not shown) that accumulates a running tally of the value of coins discharged from the hopper. The coins then pass over a coin chute 42 before reaching the downstream end of the belt to be discharged from the coin processing machine without being sorted. In yet other embodiments the coins can be physically sorted after passing over sensor device 36.

When sensor array 36 recognizes that a predetermined time period has elapsed without a coin being discharged from the hopper, the controller reverses the operating direction of turntable 12 to activate a cleaning cycle and discharge any remaining debris from hopper 10 as described above. In yet other embodiments the controller can include a manually operated switch that activates a cleaning cycle.

It should be understood that the self-cleaning intake hopper of the present invention can be adapted for use in other coin processing machines, and is not limited to the coin processing machines disclosed either directly or by reference herein.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A coin processing machine comprising an intake hopper, the intake hopper comprising:

a turntable having an inner circumference and an outer circumference, a wall extending along the outer circumference of the turntable, a singulating plate, a diverter plate, and a drive operatively connected to the turntable to rotate the turntable;

the turntable rotatable in a first direction and in an opposite second direction, the first direction defining a downstream direction and the second direction defining an upstream direction, the drive capable of rotating the turntable in the first direction at a speed sufficient to drive coins on the turntable against the wall by centrifugal force;

the wall comprising a first opening and a second opening circumferentially spaced downstream from the first opening;

the singulating plate upstream of the first wall opening and extending over the turntable, the singulating plate configured to allow a stream of coins to be discharged from the first opening when the turntable rotates in the first direction;

the diverter plate fixedly attached to the wall between the first and second openings and permanently stationary with respect to the turntable, the diverter plate extending from the wall radially inwardly over the turntable to a free end spaced radially outwardly from the inner circumference of the turntable, the diverter plate configured to direct objects on the turntable away from the second opening when the turntable rotates in the first direction and to direct objects on the turntable through the second opening when the turntable rotates in the second direction.

2. The coin processing machine of claim 1 wherein the diverter plate is spaced above the turntable a distance less than the thickness of the thinnest coin to be processed by the coin processing machine.

3. The coin processing machine of claim 1 wherein the diverter plate extends downstream from the wall opposite the second opening.

4. The coin processing machine of claim 1 wherein the hopper comprises a barrier wall over the turntable, the barrier wall extending downstream from the singulating plate and across from the first wall opening to prevent objects blocked by the singulating plate from entering the first wall opening.

5. The coin processing machine of claim 1 wherein the hopper comprises a stationary plate, the turntable mounted in said stationary plate, and a through opening in the stationary plate aligned with the second wall opening to receive objects discharged through the second wall opening.

6. The coin processing machine of claim 1 wherein the drive automatically reverses rotation of the turntable from the first direction to the second direction when coins are no longer being discharged from the hopper.

7. The coin processing machine of claim 1 wherein the drive comprises a manual drive for manually reversing rotation of the turntable from the first direction to the second direction.

8. The coin processing machine of claim 1 wherein the diverter plate extends in the downstream direction as the diverter plate extends radially inwardly from the wall.

9. The coin processing machine of claim 1 wherein the diverter plate comprises a first portion mounting the diverter plate to the wall and a second portion extending away from the wall.

10. The coin processing machine of claim 9 wherein the second portion being a generally planar portion.

11. The coin processing machine of claim 1 wherein the diverter plate extends along essentially a straight line as the plate extends away from the wall.

* * * * *